US006995344B2

(12) United States Patent
McWilliams

(10) Patent No.: US 6,995,344 B2
(45) Date of Patent: Feb. 7, 2006

(54) COOKING APPLIANCE

(75) Inventor: Kevin Ronald McWilliams, Stratford upon Avon (GB)

(73) Assignee: Ceramaspeed Limited, (GB)

( * ) Notice: Subject to any disclaimer, the term of this patent is extended or adjusted under 35 U.S.C. 154(b) by 0 days.

(21) Appl. No.: 10/481,828

(22) PCT Filed: Jun. 26, 2002

(86) PCT No.: PCT/GB02/02936

§ 371 (c)(1),
(2), (4) Date: Dec. 23, 2003

(87) PCT Pub. No.: WO03/003793

PCT Pub. Date: Jan. 9, 2003

(65) Prior Publication Data

US 2004/0178187 A1 Sep. 16, 2004

(30) Foreign Application Priority Data

Jun. 28, 2001 (GB) ..... 0115831

(51) Int. Cl.
*H05B 3/68* (2006.01)

(52) U.S. Cl. ..... 219/448.17; 219/448.19; 219/448.18; 219/451.1; 219/483; 219/460; 219/461.1; 219/486

(58) Field of Classification Search ..... 219/448.19, 219/448.18, 451.1, 452.11, 483, 458.1, 459.1, 219/460.1, 461.1, 462.1, 477–478, 481, 486, 219/494, 504–510

See application file for complete search history.

(56) References Cited

U.S. PATENT DOCUMENTS

| | | | | |
|---|---|---|---|---|
| 4,511,789 A | | 4/1985 | Goessler et al. | |
| 4,577,176 A | | 3/1986 | Bayer | |
| 4,740,664 A | | 4/1988 | Payne et al. | |
| 5,893,996 A | * | 4/1999 | Gross et al. | 219/447.1 |
| 5,951,897 A | | 9/1999 | Wauer et al. | |
| 5,961,867 A | * | 10/1999 | McWilliams | 219/446.1 |

FOREIGN PATENT DOCUMENTS

| | | | |
|---|---|---|---|
| DE | 3234349 | | 3/1984 |
| EP | 0551172 | | 7/1993 |
| EP | 943870 | * | 9/1999 |
| EP | 0943870 | | 9/1999 |
| GB | 2103910 | | 2/1983 |
| GB | 2138659 | | 10/1984 |
| GB | 2263379 | | 7/1993 |

OTHER PUBLICATIONS

United Kingdom Search Report Oct. 12, 2001.
International Search Report Oct. 17, 2002.

* cited by examiner

*Primary Examiner*—Shawntina Fuqua
(74) *Attorney, Agent, or Firm*—Ira S. Dorman

(57) ABSTRACT

The appliance has a cooking plate (10) and a radiant electric heater (2) having multiple heating zones (12, 14, 16) arranged substantially side-by-side. A temperature sensing assembly (34) incorporates an electrical component (42) located in a position confined within a first heating zone (12) and having an electrical parameter which changes as a function of temperature. Electronic control apparatus (30) is connected to the electrical component (42) by means of electrical leads (44), the electronic control apparatus being adapted to detect the number of heating zones that are energised and to control energisation of the heater in dependence thereon.

18 Claims, 2 Drawing Sheets

COOKING APPLIANCE

Figure 1:
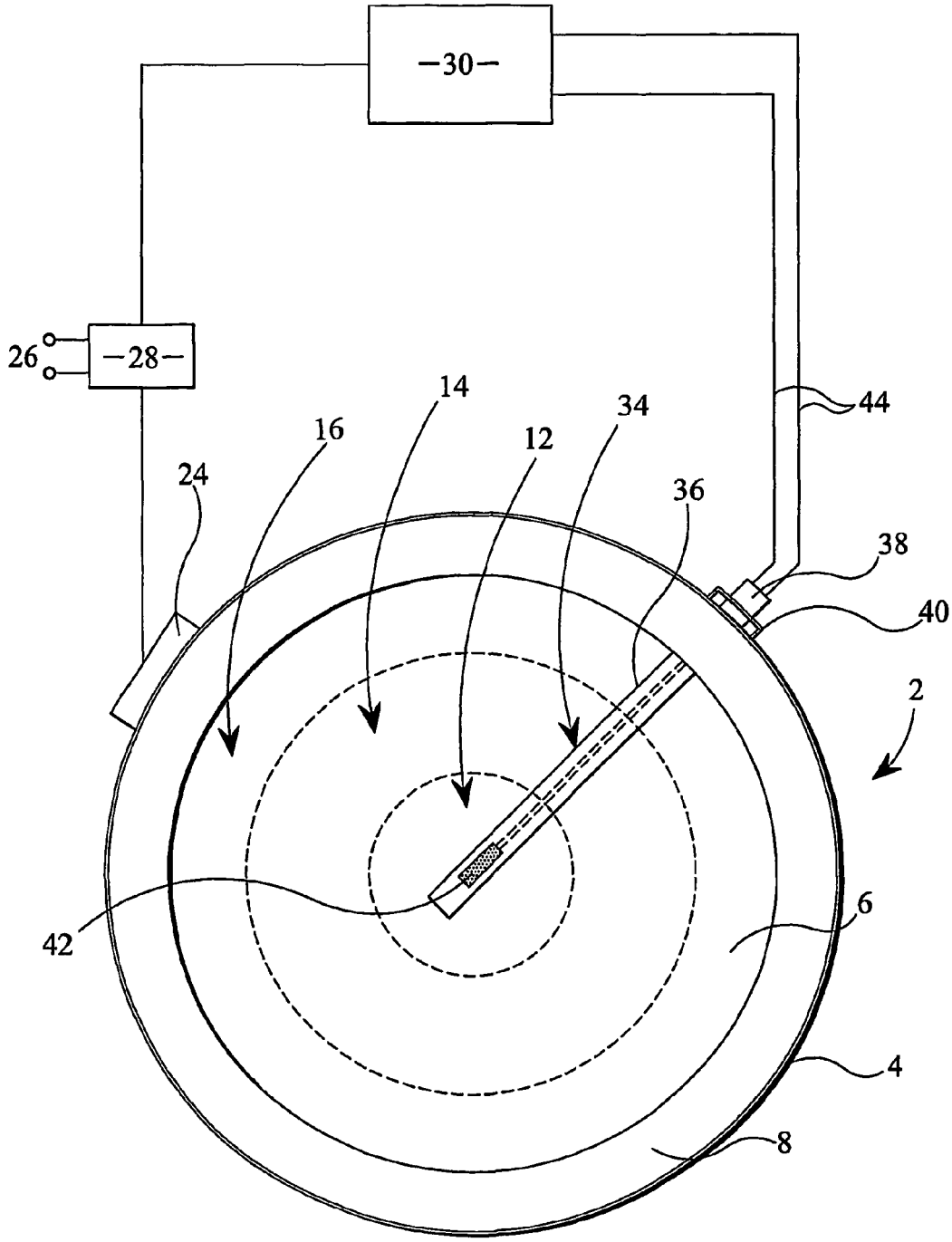

The present invention relates to a cooking appliance having a cooking plate, such as of glass-ceramic material, and incorporating a radiant electric heater having multiple heating zones. Such multiple heating zones are arranged substantially side-by side, such as in concentric relationship.

It is known, for example from GB-A-2 263 379, to provide heaters having two or three concentrically-arranged heating zones, each of which zones contains one or more electric heating elements. It is arranged for a central heating zone to be energised alone, or together with the concentrically-arranged outer heating zone or zones. Such an arrangement enables heated areas of different sizes to be provided, to accommodate cooking vessels of correspondingly different sizes on the cooking plate overlying the heater.

In order to limit the temperature of the cooking plate, to prevent damage thereto, it is well known to provide a switch device incorporating a differentially-expanding rod and tube combination which is arranged to extend across the heating zones of the heater. Such switch device is arranged to respond primarily to the central heating zone. This is achieved by providing one or more temperature-compensating sections of the rod and tube combination where it passes across the one or two outer heating zones, or by screening the rod and tube combination with thermal insulating material where it crosses the one or two outer heating zones. Such arrangements effectively thermally desensitise the rod and tube combination where it passes across the one or two outer heating zones, so that calibration of the switch device can be set under conditions where only the central heating zone is energised, without early switching of the switch device being effected when the one or two outer heating zones are additionally energised.

Such mechanical temperature-compensating or physical screening arrangements are expensive and cumbersome and not wholly satisfactory in operation.

A further problem exists in that, whereas previously it was general practice to separate the heating zones of the heater by means of one or more walls of thermal insulation material, space constraints, particularly with heaters having more than two zones, have necessitated such one or more walls being dispensed with. The heating zones are therefore undivided and, as a result, boiling performance of a liquid in a vessel located over the heater on the cooking plate is poor, except when all heating zones are energised.

It is an object of the present invention to overcome or minimise these problems.

According to the present invention there is provided a cooking appliance comprising:

a cooking plate;

at least one radiant electric heater located behind the cooking plate, the heater having:

multiple heating zones arranged substantially side-by-side and each provided with at least one electric heating element, a first heating zone being arranged to be energised alone and together with one or more further zones of the multiple heating zones, and a temperature sensing assembly for sensing a temperature of the cooking plate and incorporating an electrical component located in a position confined within the first heating zone and having an electrical parameter which changes as a function of temperature; and electronic control apparatus for the at least one heater connected to the electrical component by means of electrical leads, wherein the electronic control apparatus is adapted to detect the number of heating zones of the at least one heater that are energised and to control energisation of the heater in dependence thereon.

The multiple heating zones of the at least one heater may be undivided from one another.

The multiple heating zones of the at least one heater may be concentrically arranged and such that the first heating zone is a central heating zone which is energisable alone and together with one or more further zones arranged concentrically therewith.

The at least one heater may be provided with first and second heating zones, or first, second and third heating zones.

The at least one heater may be provided with a dish-like support comprising or incorporating a base of thermal and electrical insulation material, the heating elements of the heating zones being supported relative to the base.

The at least one heater may be provided with a peripheral wall of thermal and electrical insulation material. The peripheral wall may be separate from or integral with the base.

The electrical component may comprise a resistance temperature detector, such as a platinum resistance temperature detector, whose electrical resistance changes as a function of temperature.

The temperature sensing assembly may comprise a probe which extends from a periphery of the at least one heater across a plurality of the multiple heating zones. The electrical component may be provided within a tube of the probe assembly. The tube of the probe assembly may comprise metal, ceramic or glass-ceramic.

The cooking plate may be of glass-ceramic material.

The electronic control apparatus may be adapted to control energisation of the heater in dependence upon the detected electrical parameter of the electrical component and predicted temperature of the cooking plate covering that area of the cooking plate occupied by the heater.

The electronic control apparatus may be adapted to provide an initial temperature boost setting and/or rate of increase of temperature, in respect of the cooking plate, having regard to a selected energised heating zone or combination of energised heating zones.

The electronic control apparatus may comprise a microprocessor-based controller.

The arrangement of the temperature sensing assembly in the heater with the temperature-responsive electrical component located within the confines of the first heating zone, which is always energised, is advantageous in that the temperature-responsive electrical component responds primarily to the temperature in the first heating zone, although is thermally influenced to a small extent by the additional operation of the one or more other heating zones. It follows that it is unnecessary to provide mechanical temperature compensation or physical screening where the temperature sensing assembly extends across the outer heating zone or zones. Furthermore, the cooperation between the electronic control apparatus and the temperature-responsive electrical component enables optimised heating rates and maximum safe temperatures of the cooking plate to be obtained regardless of the selected combination of the heating zones, and provides excellent boiling performance on the cooking plate in all heating zone combinations.

Figure 2:
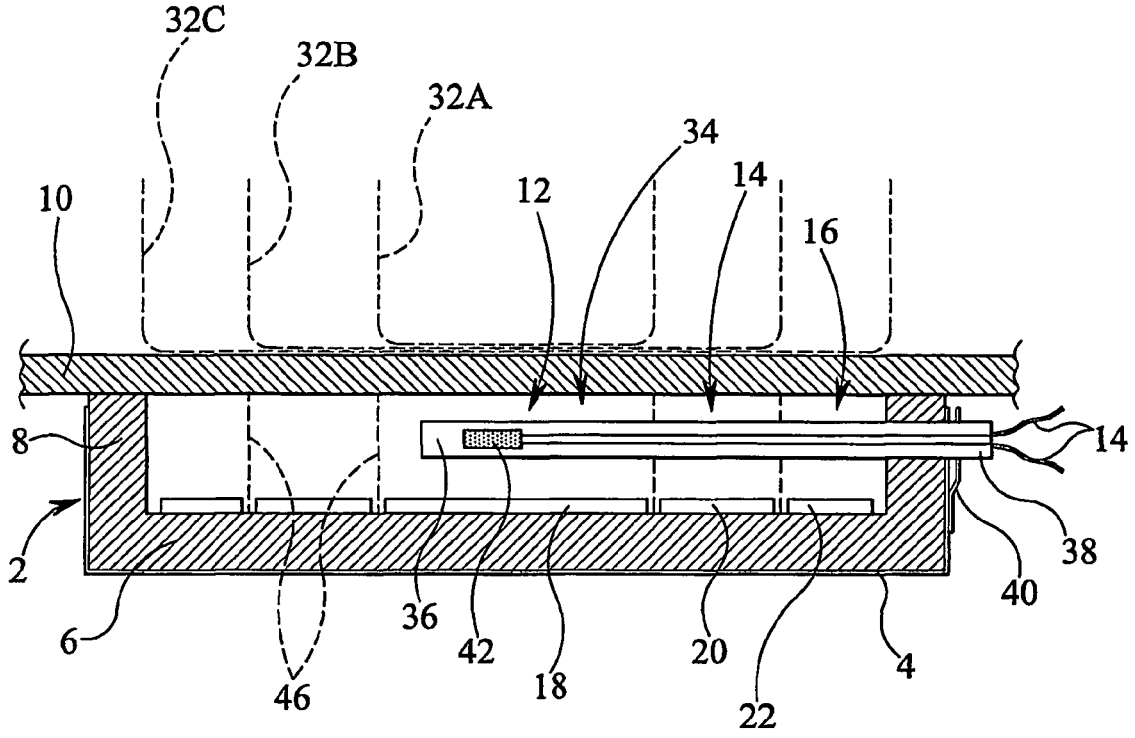

For a better understanding of the present invention and to show more clearly how it may be carried into effect, reference will now be made, by way of example, to the accompanying drawings in which:

FIG. 1 is a plan view of an embodiment of a radiant electric heater according to the present invention, provided with electronic control apparatus shown in schematic form; and FIG. 2 is a cross-sectional view of the heater of FIG. 1.

A radiant electric heater 2 comprises a metal dish-like support 4 having therein a base 6 of thermal and electrical insulation material, such as microporous thermal and electrical insulation material, and a peripheral wall 8 of thermal and electrical insulation material. The peripheral wall 8 can be integral with, or separate from, the base 6 and is arranged to contact the underside of a cooking plate 10, such as of glass-ceramic material, when the heater 2 is installed for operation in a cooking appliance.

Three undivided and merging heating zones are provided side-by-side in the heater 2. An inner, or central, heating zone 12 is formed at the centre of the heater, an intermediate heating zone 14 is formed concentrically around the inner heating zone 12 and an outer heating zone 16 is formed concentrically around the intermediate heating zone 14.

As shown in FIG. 2, the central heating zone 12 is defined by at least one heating element 18, the intermediate heating zone 14 is defined by at least one heating element 20, and the outer heating zone 16 is defined by at least one heating element 22.

The heating elements 18, 20, 22 are supported relative to the base 6 and comprise any of the well-known forms of element, such as wire, ribbon, foil or lamp forms of element, or combinations thereof. In particular, the heating elements 18, 20, 22 comprise corrugated ribbon heating elements supported edgewise on the base 6.

The heating elements 18, 20, 22 are electrically connected to a terminal block 24 and arranged for energising from a power supply 26, through a relay 28 which is controlled by microprocessor-based electronic control apparatus 30.

The heater 2 is arranged such that, when operated, the heating element or elements 18 in the central heating zone 12 is or are always energised, but can be energised additionally with the heating element or elements 20 in the intermediate heating zone 14 and further additionally with the heating element or elements 22 in the outer heating zone 16. This means that if it is required to heat a small cooking vessel 32A, located on the cooking plate 10 over substantially the central heating zone 12, only the central heating zone 12 will be arranged to be energised.

If it is required to heat a larger cooking vessel 32B, located on the cooking plate 10 over substantially the central heating zone 12 and the intermediate heating zone 14, the intermediate heating zone 14 will be arranged to be energised in addition to the central heating zone 12.

If it is required to heat a still larger cooking vessel 32C, located on the cooking plate 10 over substantially the central heating zone 12, the intermediate heating zone 14 and the outer heating zone 16, both the intermediate heating zone 14 and the outer heating zone 16 will be arranged to be energised in addition to the central heating zone 12.

A temperature sensing probe assembly 34 is arranged to extend from a periphery of the heater 2 across the three heating zones 12, 14, 16, in the space between the heating elements 18, 20, 22 and the cooking plate 10. The probe assembly 34 comprises a tube 36, such as of metal, ceramic or glass-ceramic, secured at an end 38 thereof to the metal dish-like support 4 of the heater 2 by means of a bracket 40.

A resistance temperature detector (RTD) 42, particularly a platinum resistance temperature detector (PRTD), whose electrical resistance changes as a function of temperature, is located inside the tube 36 in a position such that it is confined within the central heating zone 12. The resistance temperature detector 42 has electrical leads 44 connected thereto which pass along the tube 36 and are arranged for connection to the electronic control apparatus 30.

The construction of the temperature sensing probe assembly 34 may be as described in GB 0107042.4.

Instead of the resistance temperature detector 42, another form of electrical component having an electrical parameter which changes as a function of temperature could be considered.

Since the resistance temperature detector 42 is a relatively small discrete component located within the central heating zone 12, it responds primarily to the temperature in the central heating zone 12 and is thermally influenced to a minimal extent by the additional energising of the intermediate and outer heating zones 14 and 16. Calibration of the resistance temperature detector 42 is therefore affected only to a small extent whether or not the intermediate heating zone 14 is additionally energised, or both the intermediate heating zone 14 and the outer heating zone 16 are additionally energised, so that early switching off of the heating elements in response to the temperature sensing probe assembly 34 is unlikely to occur when one or both of the intermediate and outer heating zones 14, 16 is or are additionally energised.

The resistance temperature detector 42 is calibrated in cooperation with the electronic control apparatus 30 such that, when a predetermined temperature is reached in the central heating zone 12, the one or more heating elements 18 is or are arranged to be de-energised and also the heating elements 20 and 22, if these were energised. Overheating of the cooking plate 10 and thermal damage thereto is thus avoided. This is particularly important when the cooking plate 10 is of glass-ceramic material.

The electronic control apparatus 30 is adapted to detect the number of heating zones that are energised, namely whether the central heating zone 12 is energised alone, or with the intermediate heating zone 14, or with both the intermediate and outer heating zones 14 and 16. Such detection can be effected, for example, by determining whether or not a control knob is in a position to energise the respective heating zone.

Energisation of the heater can be controlled as a result of such detection. For example, adjustment of energisation can be effected on the basis of a desired relationship between the electrical resistance of the resistance temperature detector 42 in the probe assembly 34, and predicted temperature of the cooking plate 10 over the entire heated area of the cooking plate 10.

That is, it has been found the glass temperature sensed by the detector 42 varies in dependence on which of the heating zones is or are energised, due to a heating effect on the tube 36. However, the control apparatus 30 can compensate for such variations electronically rather than by providing additional mechanical temperature compensation or thermal screening.

The electronic control apparatus 30 may cooperate with the resistance temperature detector 42 and the electric heating elements 18, 20, 22, to provide an initial temperature boost setting and/or rate of increase of temperature, in respect of the cooking plate 10, having regard to whether the central heating zone 12 is energised alone, or with the addition of the intermediate heating zone 14, or with the further addition of the outer heating zone 16. Thus, the electronic control apparatus 30 may generate a temperature boost at the start of a cooking cycle by temporarily setting the maximum glass temperature to a higher value. The temporary maximum glass temperature can be adjusted in dependence upon which of the heating zones is or are energised.

The cooperation between the electronic control apparatus 30 and the resistance temperature detector 42 enables optimised heating rates and maximum safe temperatures of the cooking plate 10 to be obtained, regardless of the selected combination of the energised heating zones 12, 14, 16, and provides excellent boiling performance in respect of a liquid in the cooking vessel 32A, 32B, 32C, in all heating zone combinations.

A known form of cooking vessel detection arrangement (not shown) can be incorporated in the heater 2 and operating in association with the electronic control apparatus 30, to detect placement and removal of the cooking vessel 32A, 32B, 32C on and from the cooking plate 10 and effecting energising and de-energising of appropriate combinations of the heating elements 18, 20, 22.

If desired, the heating zones 12, 14, 16 could be divided by walls of thermal insulation material 46 of well-known form, located therebetween and extending between the base 6 and the cooking plate 10.

Instead of the heater 2 having three heating zones 12, 14, 16, the heater could be provided with a central heating zone and only one outer heating zone concentric therewith. Alternatively, the heater could have a central heating zone and more than two outer heating zones concentric therewith.

What is claimed is:

1. A cooking appliance comprising; a cooking plate (10);

at least one radiant electric heater (2) located behind the cooking plate, the heater having:

multiple heating zones (12, 14, 16) arranged substantially side-by-side and each provided with at least one electric heating element (18, 20, 22), a first heating zone (12) being arranged to be energised alone and together with one or more further zones (14, 16) of the multiple heating zones, and a temperature sensing assembly (34) for sensing a temperature of the cooking plate and incorporating an electrical component (42) located in a position confined within the first heating zone (12) and having an electrical parameter which changes as a function of temperature; and electronic control apparatus (30) for the at least one heater (2) and is connected to the electrical component (42) by means of electrical leads (44), wherein the electronic control apparatus is adapted to detect the number of heating zones of the at least one heater that are energised and to control energisation of the heater in dependence upon the detected electrical parameter of the electrical component and upon predicted temperature of the cooking plate covering that area of the cooking plate occupied by the heater.

2. An appliance as claimed in claim 1, wherein the multiple heating zones (12, 14, 16) of the at least one heater (2) are undivided from one another.

3. An appliance as claimed in claim 1 wherein the multiple heating zones (12, 14, 16) of the at least one heater (2) are concentrically arranged and such that the first heating zone (12) is a central heating zone which is energisable alone and together with one or more further zones (14, 16) arranged concentrically therewith.

4. An appliance as claimed in claim 1, wherein the at least one heater (2) is provided with first and second heating zones.

5. An appliance as claimed in claim 1, wherein the at least one heater (2) is provided with first, second and third heating zones.

6. An appliance as claimed in claim 1, wherein the at least one heater (2) is provided with a dish-like support (4) comprising a base (6) of thermal and electrical insulation material, the heating elements of the heating zones being supported relative to the base.

7. An appliance as claimed in claim 6, wherein the at least one heater (2) is provided with a peripheral wall (8) of thermal and electrical insulation material.

8. An appliance as claimed in claim 1, wherein the electrical component (42) comprises a resistance temperature detector whose electrical resistance changes as a function of temperature.

9. An appliance as claimed in claim 8, wherein the resistance temperature detector comprises a platinum resistance temperature detector.

10. An appliance as claimed in claim 1, wherein the temperature sensing assembly (34) comprises a probe which extends from a periphery of the at least one heater (2) across a plurality of the multiple heating zones (12, 14, 16).

11. An appliance as claimed in claim 10, wherein the electrical component (42) having an electrical parameter which changes as a function of temperature is provided within a tube (36) of the probe assembly.

12. An appliance as claimed in claim 11, wherein the material of the tube (36) of the probe assembly is selected from metal, ceramic and glass-ceramic.

13. An appliance as claimed in claim 1, wherein the cooking plate (10) comprises glass-ceramic material.

14. An appliance as claimed in claim 1, wherein the electronic control apparatus (30) is adapted to provide an initial temperature boost setting, in respect of the cooking plate (10), having regard to one of a selected energised heating zone and a combination of energised heating zones.

15. An appliance as claimed in claim 1, wherein the electronic control apparatus (30) is adapted to provide an initial rate of increase of temperature, in respect of the cooking plate (10), having regard to one of a selected energised heating zone and a combination of energised heating zones.

16. An appliance as claimed in claim 1, wherein the electronic control apparatus (30) comprises a microprocessor-based controller.

17. An appliance as claimed in claim 1, wherein the at least one heater is provided with a dish-like support incorporating a base of thermal and electrical insulation material, the heating elements of the heating zones being supported relative to the base.

18. An appliance as claimed in claim 17, wherein the at least one heater is provided with a peripheral wall of thermal and electrical insulation material.

* * * * *